US010723533B2

(12) United States Patent
Zagar et al.

(10) Patent No.: US 10,723,533 B2
(45) Date of Patent: Jul. 28, 2020

(54) CONVEYABLE SORTATION BAG

(71) Applicant: Amazon Technologies, Inc., Seattle, WA (US)

(72) Inventors: Chad Zagar, North Bend, WA (US); Sivan Almosnino, Bellevue, WA (US); Mark Bosley, Seattle, WA (US); James Dore' Emmitt, Seattle, WA (US); Austin Paul Koehler, Maple Valley, WA (US); Yunior Ricardo Licea Rosales, Kirkland, WA (US); Robert P. Roller, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/720,661

(22) Filed: Sep. 29, 2017

(65) Prior Publication Data

US 2019/0100368 A1 Apr. 4, 2019

(51) Int. Cl.

| | |
|---|---|
| ***B65D 81/02*** | (2006.01) |
| ***B65D 33/25*** | (2006.01) |
| ***B07C 3/00*** | (2006.01) |
| ***B65D 33/08*** | (2006.01) |
| ***B65D 30/10*** | (2006.01) |

(Continued)

(52) U.S. Cl.

CPC ..... *B65D 81/02* (2013.01); *B07B 13/04* (2013.01); *B07C 3/00* (2013.01); *B07C 3/008* (2013.01); *B65D 31/10* (2013.01); *B65D 31/16* (2013.01); *B65D 33/08* (2013.01); *B65D 33/14* (2013.01); *B65D 33/2508* (2013.01); *B65D 71/06* (2013.01); *B65D 29/00* (2013.01); *B65D 2203/10* (2013.01)

(58) Field of Classification Search

CPC ..... B65D 81/02; B65D 29/00; B65D 71/06; B07B 13/04

USPC ..... 383/105, 7, 9, 120

See application file for complete search history.

(56) References Cited

U.S. PATENT DOCUMENTS 2,584,633 A * 2/1952 Southwick, Jr. ..... B65D 33/02 156/202

2,821,337 A * 1/1958 Morgan, Jr. ..... B65D 31/005 383/107

(Continued)

FOREIGN PATENT DOCUMENTS

FR 2789363 A1 8/2000

OTHER PUBLICATIONS

International Patent Application No. PCT/US2018/053387; Int'l Search Report and the Written Opinion; dated Jan. 4, 2019; 14 pages.

*Primary Examiner* — Peter N Helvey

(74) *Attorney, Agent, or Firm* — BakerHostetler

(57) ABSTRACT

A method of sorting a first subset of items in an order handling center, wherein at least a majority of the items of the first subset are sized below a predetermined size limit. The method includes directing the first subset of the items through an opening into a bag having a plurality of panels of flexible material coupled together at a plurality of seams. The method includes causing the bag to assume a substantially cuboid shape as the bag is filled to capacity with the first subset of items and stacking the bag on a pallet at a staging destination within the order handling center. The staging destination is associated with a delivery route from the order handling center.

15 Claims, 5 Drawing Sheets

(51) Int. Cl.

| | |
|---|---|
| ***B65D 33/14*** | (2006.01) |
| ***B65D 30/20*** | (2006.01) |
| ***B07B 13/04*** | (2006.01) |
| ***B65D 71/06*** | (2006.01) |
| *B65D 30/00* | (2006.01) |

(56) References Cited

U.S. PATENT DOCUMENTS

| | | | | | |
|---|---|---|---|---|---|
| 3,512,700 | A * | 5/1970 | Evans | B65D 31/00 | 383/120 |
| 3,580,486 | A * | 5/1971 | Kugler | B65D 31/00 | 383/120 |
| 4,232,721 | A * | 11/1980 | Martin | A61J 1/10 | 222/107 |
| 4,759,642 | A * | 7/1988 | Van Erden | B65D 31/00 | 229/117.35 |
| D297,113 | S * | 8/1988 | Benoit | D9/703 | |
| D302,112 | S * | 7/1989 | Benoit | D9/703 | |
| 5,348,398 | A * | 9/1994 | Buchanan | B65D 31/08 | 383/104 |
| 6,120,183 | A * | 9/2000 | Buchanan | B31B 70/00 | 383/104 |
| 6,942,100 | B2 * | 9/2005 | Su | B65D 31/10 | 206/554 |
| 2005/0139508 | A1 * | 6/2005 | Su | B65D 31/10 | 206/554 |
| 2006/0215941 | A1 * | 9/2006 | Golbert | A47F 13/085 | 383/8 |
| 2007/0230833 | A1 | 10/2007 | Winiecki | | |
| 2008/0199107 | A1 * | 8/2008 | Nicholson | A45C 7/0077 | 383/7 |
| 2009/0266722 | A1 | 10/2009 | Rogers et al. | | |
| 2017/0036816 | A1 | 2/2017 | Davidson | | |

* cited by examiner

CONVEYABLE SORTATION BAG

BACKGROUND

In an order handling facility, such as a sortation center, multiple customer packages are processed that each contain one or more items from inventory to be shipped to customers. Packages of various sizes can be inducted into a sortation and conveyance network that ultimately directs the packages to various staging destinations within the sortation center. The staging destinations can be arranged based on various delivery routes assigned to the sortation center. For example, packages may be sorted according to delivery zip codes and the staging destinations may be arranged based on the delivery zip codes. At the staging destinations, packages may be packed onto pallets, which can then be loaded onto trucks or other vehicles for delivery.

Packages can further be sorted, prior to conveyance to the staging destination, based on package size. For example, at one or more areas within the sortation and conveyance network, packages can be unloaded from a gaylord and sorted based on their size. In the sortation center, packages may be categorized within various size categories, such as, by way of non-limiting example, "small", "medium", and "large" packages, wherein each size category may be defined by maximum or minimum predetermined dimensions and/or weight. For example, "small" packages may be categorized as packages having dimensions less than 12 inches×16 inches×6 inches and weighing 25 lbs or less. Such small packages, or "smalls" as they may be termed, can be sorted from the other sizes and consolidated to possibly bypass at least some portions of the conveyance network. For example, small packages destined for a specific staging destination within the sortation center can be loaded into a container, such as a bag or tote, which can then be conveyed to the staging destination. In many instances, an associate within the sortation center places the filled bag or tote onto a cart and physically walks the cart to the staging destination. "Small" packages commonly include cardboard or paperboard boxes, mailers (such as padded "jiffy" mailers) "poly bags," and other parcel types.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

The embodiments of the present disclosure pertain to sortation bags that are configured to be filled with small packages and then mechanically conveyed (while containing the small packages) to a staging destination. In some cases, such a configuration of the sortation bag increases sortation efficiency because small packages, which are often poly bag type packages, tend to underperform when conveyed directly on a mechanical conveyance. This is sometimes so because, in some circumstances, small packages, such as poly bags, have "pinch points" that can get stuck in, or otherwise interfere with, mechanical conveyance. For example, some poly bags have edges, corners, and the like that are unsupported and/or weak that form pinch points. Pinch points on the bags lead to higher damage rates for small packages and the conveyors that interacts with or "touch" small packages.

In some order handling centers, small packages can account for about 20% of the sorted packages that are conveyed to a staging destination, which percentage is expected to increase in the future. By consolidating the small packages into a sortation bag and conveying the bag to the staging destination, the small packages can effectively bypass many portions of the conveyance network so that the total number of "touches" for small packages is significantly reduced, which reduces damage to the packages, conveyance, and sortation equipment, as well as reduces customer concessions and sorting downtime. In this manner, the inventive bag disclosed herein allows a higher volume of small packages to be processed in the order handling center, including up to 75%-80% of the total volume of packages processed in the handling center.

The sortation bags disclosed herein are designed with built-in geometries and rigidities that are configured to allow the filled sortation bags to be conveyed on various types of conveyance, such as gravity conveyors, belt conveyors (including those utilizing slat belts), and roller conveyors, by way of non-limiting examples, without snagging, catching, or otherwise interfering with operation of the conveyance. The built-in geometry and rigidity of the sortation bag allows the bag to at least substantially assume a cuboid or box-like shape as it is filled with items, such as small packages, which filled, cuboid shape enables the bag to be closed and conveyed on its side like a low-profile box by mechanical conveyance (including high-speed and high throughput conveyance), preferably along with large packages, to a downstream destination within the order handling center.

Figure 1:
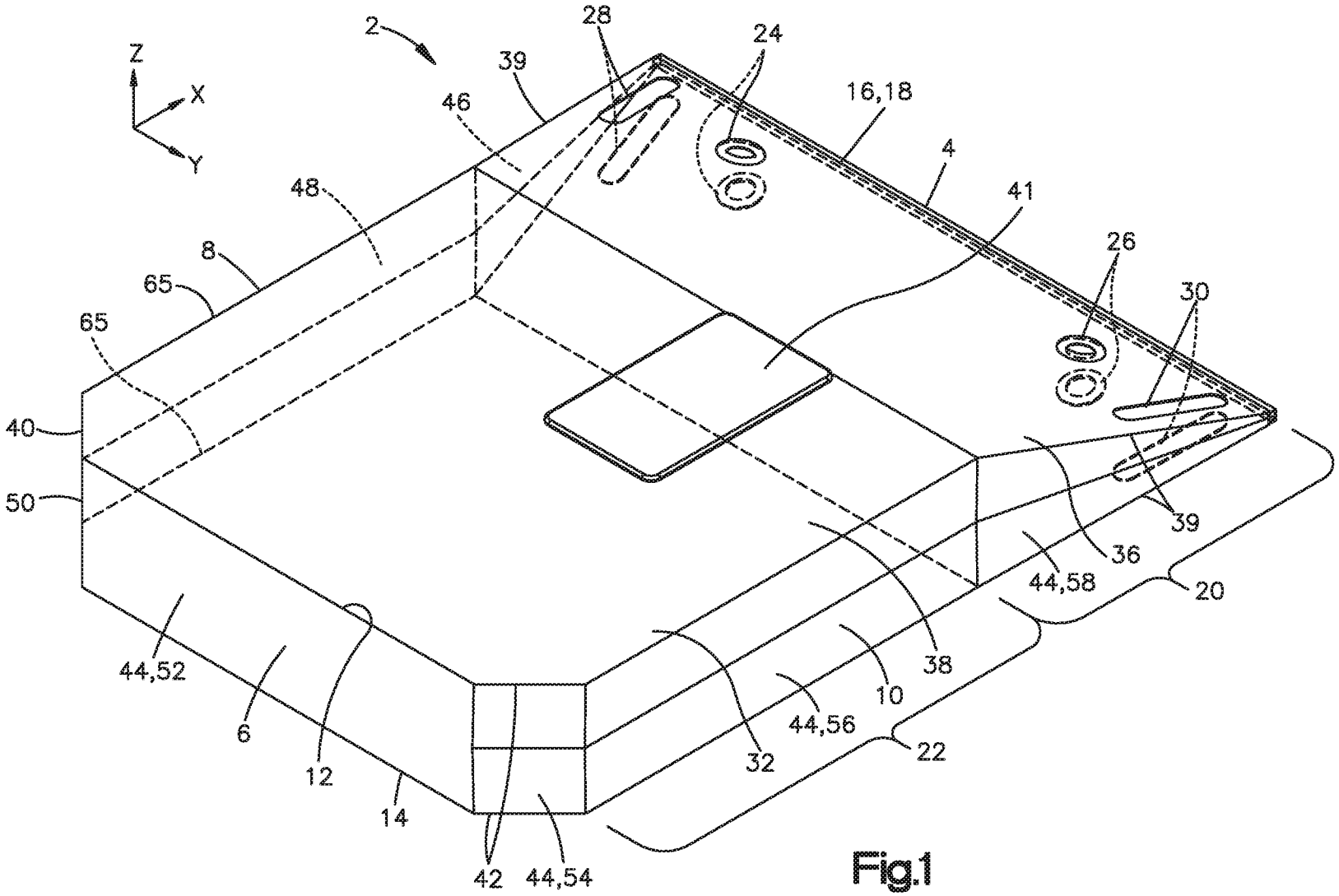
FIG. 1 shows a perspective view of a conveyable sortation bag, according to an embodiment of the present disclosure.
Figure 2:
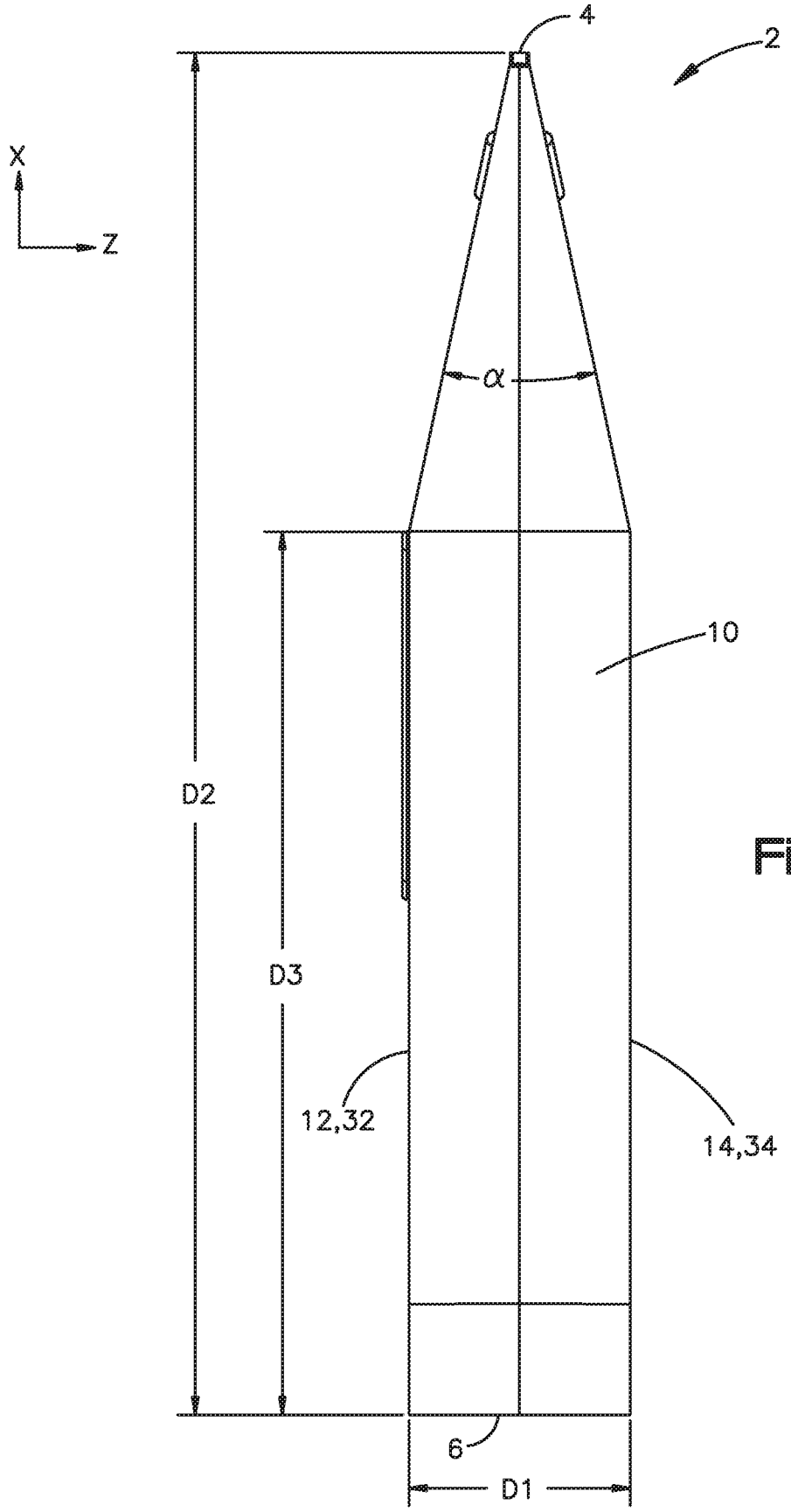
FIG. 2 shows an end view of the conveyable sortation bag of FIG. 1.

Referring to FIGS. 1 and 2, a sortation bag 2 having the foregoing characteristics is shown in a first configuration. The bag 2 includes a plurality of panels coupled together at one or more seams. The panels can be formed of a material that is foldable for storage purposes yet durable for use. One example of such a material is a blended mesh polypropylene having a mono filament, plain weave construction, which material is a tight-woven, semi-transparent mesh that allows operators and/or sensors the ability to see items located inside the bag 2 as the bag 2 is being filled. The foregoing material is also light, having a fabric weight of only about 130 g/m$^2$. The bag 2 can also optionally include liner portions, such as plain weave, polyethylene slit film liner portions each having a fabric weight of about 120 g/m$^2$. The foregoing blended mesh polypropylene is also breathable, which provides the additional benefit of preventing the bag 2 from being airtight and inadvertently trapping air, which would otherwise cause the bag 2 to occupy a greater volume of space than necessary and take up unnecessary room on sortation equipment and/or mechanical conveyance, as well as to unfavorably reduce the stability of the bag as it is sorted and/or conveyed. Alternatively, the panels can be formed of other materials, including nylon, for example. The foregoing bag materials are provided as examples of the types materials that can be employed in the bag constructions. Other materials are within the scope of the present disclosure.

It is to be appreciated that the first configuration depicted in FIGS. 1 and 2 can be characterized as a theoretical, volumetrically ideal configuration in which each panel of the bag 2 extends solely along one or more planes. In actuality, the bag 2 material has a degree of flexibility, which allows the bag 2 to be folded for storage before or after use. It is to be appreciated that, while the following description of the various portions of the bag 2 with reference to FIGS. 1 and 2 refer to the bag 2 in the first configuration, the bag 2 can be folded or otherwise manipulated as necessary out of the first configuration. The bag 2 includes an upper end 4 and a lower end 6 opposite each other along a longitudinal direction X; a first end 8 and a second end 10 opposite each other along a lateral direction Y that is substantially perpendicular to the longitudinal direction X; and a first side 12 and a second side 14 opposite each other along a transverse direction Z that is substantially perpendicular to the longitudinal and lateral direction X, Y. It is to be appreciated that, as used herein, the terms "longitudinal" and "longitudinally" mean "with respect to the longitudinal direction X"; the terms "lateral" and "laterally" mean "with respect to the lateral direction Y"; and the terms "transverse" and "transversely" mean "with respect to the transverse direction Z".

The bag 2 defines an opening 16 through which items, such as small packages, for example, can be inserted into the bag 2. The opening 16 can be located at the upper end 4 of the bag, as shown, although other opening locations on the bag 2 are within the scope of the present disclosure. The opening 16 includes a closure feature, such as a zipper 18, which is shown in FIGS. 1 and 2 as being in a closed configuration. In other embodiments, the closure feature can include a drawstring, one or more straps, one or more clamps, or other features for closing the opening 16.

The bag 2 can define an entry portion 20 adjacent the opening 16 and a containment portion 22 that extends from the entry portion 20 to the lower end 6 of the bag 2. The bag 2 can also include coupling features, such as apertures, that are configured to receive one or more support elements for supporting the bag 2 in an open receiving configuration so that items can be inducted into the bag 2, as set forth in more detail below. The apertures can include a first pair of receiving apertures 24 located transversely opposite each other on the first and second sides 12, 14 of the bag 2 and a second pair of receiving apertures 26 located transversely opposite each other on the first and second sides of the bag 2. The first and second pairs of receiving apertures 24, 26 can optionally be defined by grommets that are configured to enhance the structural stability of the portions of the bag 2 surrounding the apertures 24, 26. The bag 2 can also define handling features, such as handles or grips, that are configured to allow an operator to lift, carry, or otherwise manipulate the bag 2. As shown, the handling features can include a first pair of handle apertures 28 located transversely opposite each other on the first and second sides 12, 14 of the bag 2 and a second pair of handle apertures 30 located transversely opposite each other on the first and second sides 12, 14 of the bag 2. The first and second pairs of handle apertures 28, 30 can be located proximate the first and second ends 8, 10 of the bag 2 and can each be elongated primarily along the longitudinal direction X and can be sized for easy purchase by the hands of an operator.

The panels of the bag 2 include a first side panel 32 defining the first side 12 of the bag 2 and a second side panel 34 defining the second side 14 of the bag 2. The first and second side panels 32, 34 can be substantial mirror images of each other about a geocentric mid-plane extending along the longitudinal and lateral directions X, Y. Each of the first and second side panels 32, 34 can extend longitudinally from the upper end 4 to the lower end 6 of the bag 2 and laterally from the first side 8 to the second side 10 of the bag 2.

Figure 3:
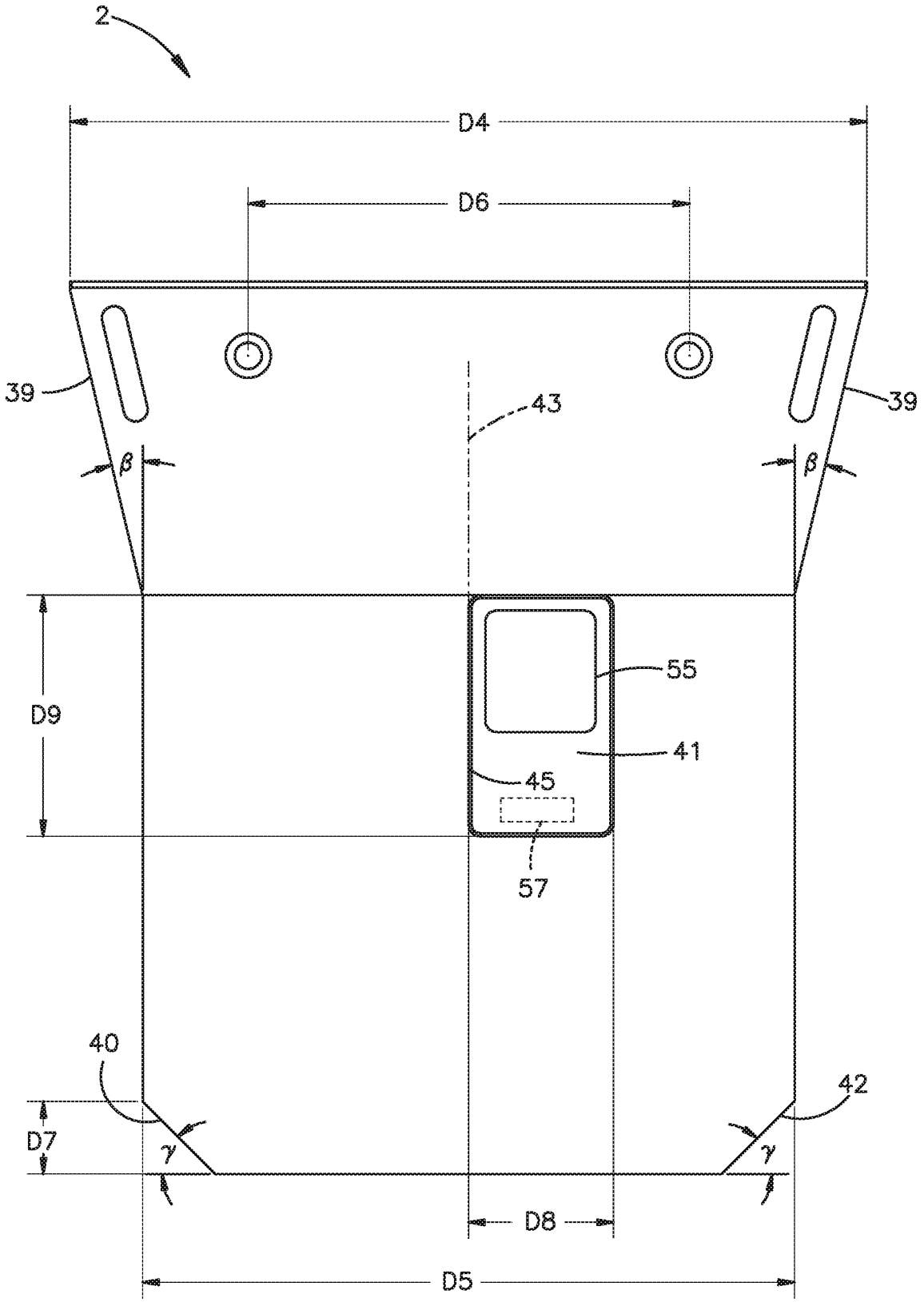
FIG. 3 shows a front view of the conveyable sortation bag of FIG. 1.

Each of the first and second side panels 32, 34 can define a first or upper side panel portion 36 within the entry portion 20 of the bag 2 and a second or lower side panel portion 38 within the containment portion 22 of the bag 2. The upper and lower side panel portions 36, 38 can be shaped to provide the bag 2 with an advantageous geometry as the bag 2 is filled with small items. For example, the upper side panel portions 36 can transversely converge towards each other at a first taper angle $\alpha$ at the upper end 4 of the bag 2, as shown in FIG. 2. The first taper angle $\alpha$ can be in the range of about 15 degrees and about 120 degrees. Additionally, outer lateral edges 39 of each upper side panel portion 36 can taper laterally outward as they extend toward the upper end 4 of the bag 2, so as to define a second, acute taper angle $\beta$ with respect to a longitudinal axis, as shown in FIG. 3. The second taper angle $\beta$ can be in the range of about 5 degrees and about 40 degrees. Preferably, the first and second taper angles $\alpha$, $\beta$ can be maintained at a relationship such that the first taper angle $\alpha$ is about twice as wide as the second taper angle $\beta$. For example, in some embodiments, the first taper angle $\alpha$ can be in the range of about 20 and 30 degrees, and optionally about 26 degrees, and the second taper angle $\beta$ can be in the range of about 10 and 15 degrees, and optionally about 13 degrees. When the first and second taper angles $\alpha$, $\beta$ are maintained at a 2:1 ratio, the upper end 4 of the bag 2 can assume the same rectangular cross-sectional shape (i.e., in the Z-Y plane) as the lower portions of the bag 2, allowing the bag 2 to assume a substantially uniform cuboid shape top to bottom.

Figure 4:
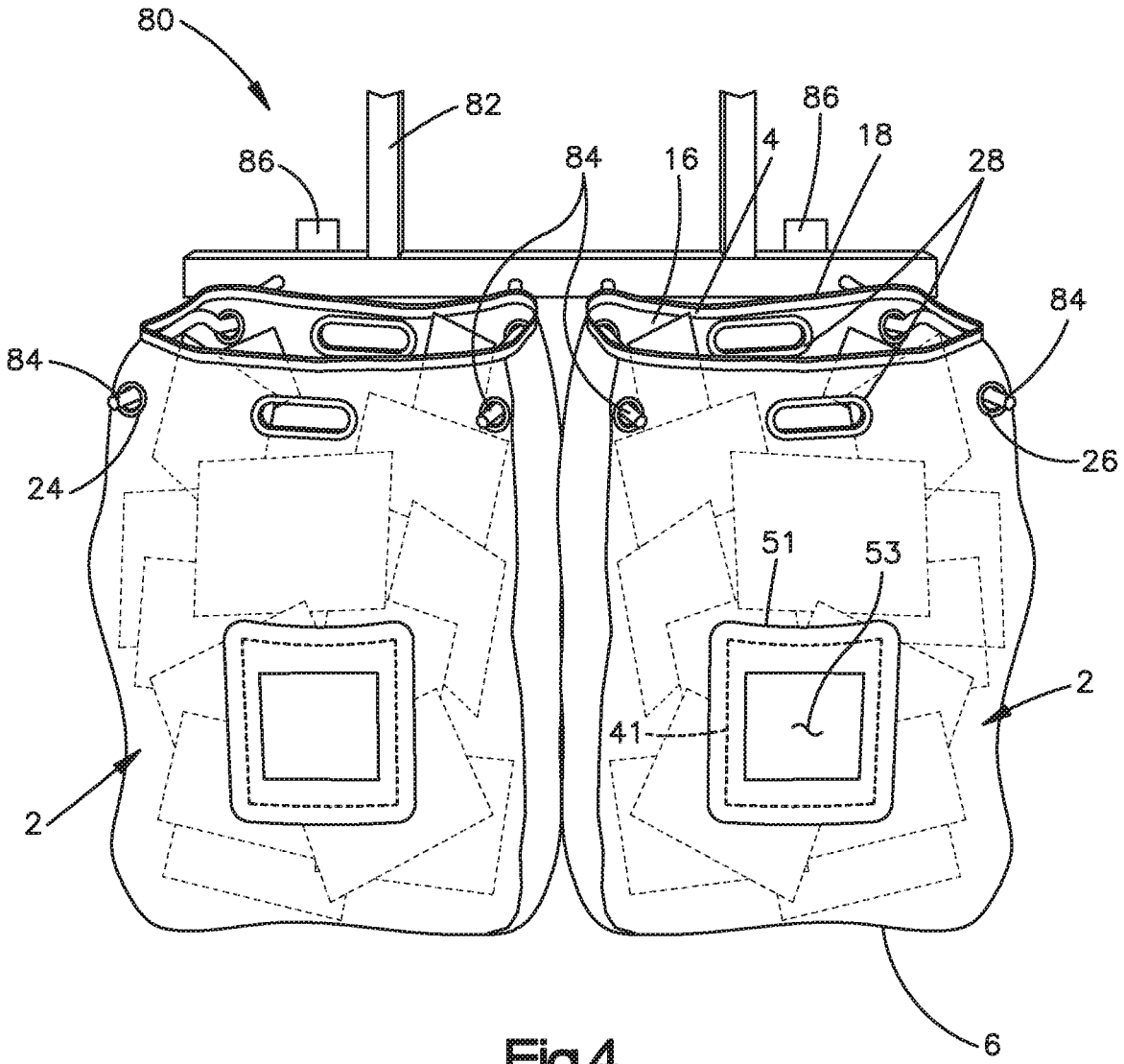
FIG. 4 shows a perspective view of a sorting station employing a plurality of conveyable sortation bags, similar to the bag shown in FIG. 1, with small-sized packages inserted within the bags, according to an embodiment of the present disclosure.

The bag 2 can include an identification feature, such as a rigid plate 41 that is configured to receive a label or tag for identifying the bag. As shown in FIG. 4, the rigid plate 41 can optionally be disposed within a pouch 51 sewn on one of the first and second side panels 32, 34. In such embodiments, the outer surface of the pouch can additionally have a receiving surface 53 configured for receiving labels 55 (FIG. 3) in a manner where the labels 55 can be removed as necessary, preferably without undue difficulty. For example, the receiving surface 53 can be defined by a thermoplastic panel, such as black polystyrene, which can be sewn on the outer surface of the pouch 51. In other embodiments, the feature can carry a radio frequency identification (RFID) tag 57 (FIG. 3) that can be scanned or otherwise detected by one or more radio frequency (RF) receivers located throughout the sortation and conveyance network. In this manner, once the bag 2 is filled to capacity with small packages, a computer-based control unit can associate the RFID tag 57 with package sortation data, such as an identification of each of the small packages loaded in the bag 2.

At the lower end 6 of the bag 2, the lateral corners can be tucked or otherwise relieved so as to remove potential snag or pinch points between the bag 2 and the conveyance. In the illustrated embodiment, side panels 32, 34 can collectively define a first relief segment 40 at the boundary between the lower end 6 and the first end 8, as well as a second relief segment 42 at the boundary between the lower and 6 and the second end 10. Each of the first and second relief segments 40, 42 can be oriented at a third, acute relief angle γ with respect to a lateral axis. The third, relief angle γ can be in the range of about 5 degrees and about 70 degrees and preferably about 45 degrees. The inventors have found, through numerous tests of the filled bag 2 on mechanical conveyor lines, that the foregoing relief angle γ range successfully prevented pinch points forming at the bottom corners as the bag 2 was filled to capacity, allowing the bag 2 to be conveyed, even through high-speed and high-throughput portions of the conveyance network without snagging or otherwise interfering with the conveyance. The inventors have observed that, without the relief segments 40, 42 oriented at the third relief angle γ, the bottom corners of the bag 2 would have a propensity to form pinch points that negatively affect the bag's ability to be conveyed along the conveyance network to a staging destination.

A third panel, such as a yoke panel 44 (which can also be referred to as a "gusset" or a "gusset panel"), can extend transversely between the first and second side panels 32, 34. The yoke panel 44 can extend continuously around a periphery of the bag 2 along one or more seams 65 connecting the yoke panel 44 to the first and second side panels 32, 34. In this manner, the yoke panel 44 can extend from the upper end 4 of the bag 2 and along the first end 8, along the first relief segment 40, along the lower end 6, along the second relief segment 42, and along the second end 10 back to the upper end 4. In this manner, the yoke panel 44 can be substantially U-shaped or trough-shaped, and can be characterized as a peripheral panel. Additionally, the geometry of the side panels 32, 34 can effectively define the geometry of the various portions of the yoke panel 44. For example, the yoke panel 44 can include a first yoke section 46 between the upper side panel portions 36 at the first end 8; a second yoke section 48 between the lower side panel portions 38 at the first end 8; a third yoke section 50 between the lower side panel portions 38 at the first relief segment 40; a fourth or bottom yoke section 52 at the bottom end 6; a fifth yoke section 54 between the lower side panel portions 38 at the second relief segment 40; a sixth yoke section 56 between the lower side panel portions 38 at the second end 8; and a seventh yoke section 58 between the upper side panel portions 36 at the second end 8. The second, third, fourth, fifth and sixth yoke section 48, 50, 52, 54, 56 can each be rectangular, causing the bag 2 to assume a substantially cuboid configuration when being filled with small packages. The bottom yoke section 52 can define the bottom end 6 of the bag 2. The third and fifth yoke sections 50, 54 can define the relieved bottom lateral corners of the bag 2, and can each be oriented at the third, acute relief angle γ.

At the seams 65, the edges of the yoke panel 44 and the peripheral edges of the side panels 32, 34 can be jointly sewn to a binder strip, such as a warp knit polyester binder strip, by way of non-limiting example. In other embodiments, the panel edges can be connected at the seams 65 by direct binding, fusion, and/or adhesives. It is to be appreciated that, to further add rigidity to the bag 2, the seams 65, including the corners thereof, can be supported by rigid or semi-rigid support members, such as rods, wires, or segmented, spine-like structures, by way of non-limiting example.

Referring to FIG. 2, in the first configuration, the side panels 32, 34 can be transversely spaced from each other by a first distance D1. The upper and lower ends 4, 6 of the bag 2 can be longitudinally spaced from each other by a second distance D2. The lower side panel portion 38 can define a third, longitudinal distance D3.

Referring to FIG. 3, in the first configuration, the upper end 4 of the bag 2 can define a fourth, lateral distance D4. In the lower side panel portion 38 can define a fifth, lateral distance D5. The first pair of coupling apertures 24 can be laterally spaced from the second pair of coupling apertures 26 by a sixth distance D6 (measured center-to-center). The first and second relief segments 40, 42 can each define a seventh, longitudinal distance D7. The plate 41 can define an eighth, lateral distance D8 and a ninth, longitudinal distance D9. In the illustrated embodiment, the rigid plate 41 is laterally offset so that a first lateral edge 45 of the plate 41 is aligned with a longitudinal centerline 43 of the bag 2. In this manner, the bag 2 can be folded in half about the longitudinal centerline 43 without interference by the plate 41. Additionally, the eighth distance D8 can be slightly less than ¼ of the fifth distance D5, which allows the bag 2 to be folded into lateral-wise quarters without interference from the plate 41. Moreover, the plate 41 can be sized and located to as to be confined within a middle third of the bag 2 longitudinal-wise, which allows the bag 2 to be folded into longitudinal-wise thirds without interference from the plate 41.

In one example embodiment, the first distance D1 is in the range of about 4.0 inches and about 8.0 inches; the second distance D2 is in the range of about 24.5 inches and about 50.0 inches; the third distance D3 is in the range of about 16.0 inches and about 32.0 inches; the fourth distance D4 is in the range of about 22.0 inches and about 44.0 inches; the fifth distance D5 is in the range of about 18.0 inches and about 36.0 inches; the sixth distance D6 is in the range of about 12.0 inches and about 24.0 inches; the seventh distance D7 is in the range of about 2.0 inches and about 4.0 inches; the eighth distance D8 is in the range of about 4.0 inches and about 8.0 inches; and the ninth distance D9 is in the range of about 6.5 inches and about 13.5 inches.

In another example embodiment, the first distance D1 is about 6.0 inches; the second distance D2 is about 37 inches; the third distance is about 24 inches; the fourth distance D4 is about 33.0 inches; the fifth distance D5 is about 27.0 inches; the sixth distance D6 is about 18.25 inches; the seventh distance D7 is about 3.0 inches; the eight distance D8 is about 6.0 inches; and the ninth distance D9 is about 10.0 inches; the first taper angle α is about 26 degrees; the second taper angle β is about 13 degrees, and the third, relief angle γ is in about 45 degrees. It is to be appreciated that the foregoing example embodiments represent examples of the various dimensions by which the bag 2 can be sized. Additionally, the bag 2 can be scaled larger or smaller than the dimensions set forth above, as needed.

In further embodiments, regardless of the overall scale of the bag 2, the first distance D1 can be maintained so as to be less than the second distance D2 by a ratio D1:D2 of about 0.7:1; about 0.6:1, or preferably 0.5:1 or less. In this manner, the bag 2 can have a low center of gravity when conveyed while lying on one of its side panels 32, 34. This allows the bag 2 to maintain its orientation on a conveyor line, allowing higher conveyance speeds, smaller gaps between adjacent bags 2 and or other non-small packages, higher throughput, and more accurate scanning, among other things. This also allows the bag 2 to be stacked more effectively on a pallet. The inventors have observed that a plurality of bags 2 with the foregoing proportions can be stacked on top of each other on a pallet so as to form a full pallet of stacked bags 2. The stacking capabilities of the filled bags 2 provides significant palletization and delivery advantages over prior art bags or totes. In additional embodiments, regardless of the scale of the bag 2, the second distance D2 and the fifth distance D5 can be maintained at a ratio D2:D5 of about 1.2:1 or greater. The precise control over the geometry of the bag 2 enhances the predictability of the behavior of the bag 2 on the conveyance network. Thus, the bags 2 can be placed on the conveyance closer to one another so as to remove gaps and increase throughput.

As set forth above, the bag 2 is configured to at least substantially assume a cuboid or box-like shape as it is filled with small packages, even if the small packages are irregularly shaped. Referring now to FIG. 4, a sorting station 80 is shown having a plurality of sortation bags 2, some of which are at least partially filled with small packages. The bags 2 are configured to be subsequently conveyed, with the small packages inside, to a staging destination. The sorting station 80 can include a rack 82 having rack arms 84 that extend through the receiving apertures 24, 26. As small packages are inducted into the bags 2, the geometry and rigidity of the bags 2 causes the bags 2 to assume a substantially cuboid shape, such as that generally consistent with a low-profile box. Additionally, as the bag 2 is filled, the side panels 32, 34 can flex transversely outward to a degree, which effectively pulls the outer lateral edges 39 of the upper side portions 36 laterally inward so that the opening defines a rectangular shape consistent with a lateral-transverse Y-Z cross-section of the bag 2. The inventors have observed, through numerous tests, that the geometry and rigidity of the bags 2 favorably enhances edge-alignment between the bag 2 and the small packages inducted therein. Moreover, the cuboid shape is generally uniform from the bottom end 6 to the top end 4 of the bag 2.

Additionally, the semi-transparency of the bag 2 material allows substantial visualization of items within the bag 2. Thus, an operator at the sorting station 80 can observe if inducted packages "bridge" with one another, or otherwise occupy more space than necessary, inside the bag, and can simply shake or otherwise manipulate the bag 2 (such as via the handle apertures 28) to settle or otherwise favorably reposition the packages in the bag 2. In the illustrated embodiment, the bag 2 includes a single pair of centrally located, laterally elongated handle apertures 28. Optionally, the sorting station 80 can include one or more electrical sensors 86, such as ultrasonic sensors or optical sensors, that are configured to detect the filled volume of the bag. The one or more electrical sensors 86 at the sorting station 80 can optionally include a scale or other type of weight sensor for determining when the bag 2 has reached a predetermined weight limit, such as an established weight-limit for single-person lifting or a weight limit for conveyance on a conveyance line. The one or sensors 86 can be in communication with a control unit, such as a processor, that is configured to transmit a signal to the operator indicating when the bag 2 is filled or nearly filled to a predetermined limit.

When it is determined that a bag 2 is full, the opening 16 can be closed, such as by zipping the zipper 18, and the bag 2 can be placed on a conveyance line, such as a primary sorter induction line, for example. As mentioned above, the rectangular bottom yoke section 52 and the relieved third and fifth yoke sections 50, 54 of the bag 2 reduce the likelihood of bag pinch points interacting unfavorably with the conveyance. Moreover, the bag 2 can be laid on one of its side panels 32, 34 on the conveyance line, preferably on the second side panel 34 so that the identification plate 41 is visible to scanning sensors. In either orientation, the inventors have observed that the bag 2 substantially maintains its orientation on the conveyance line. Thus, the geometry and rigidity of the bag 2 allows the bag 2 to interact with the conveyance in a manner substantially similar to that of a low-profile box.

Figure 5:
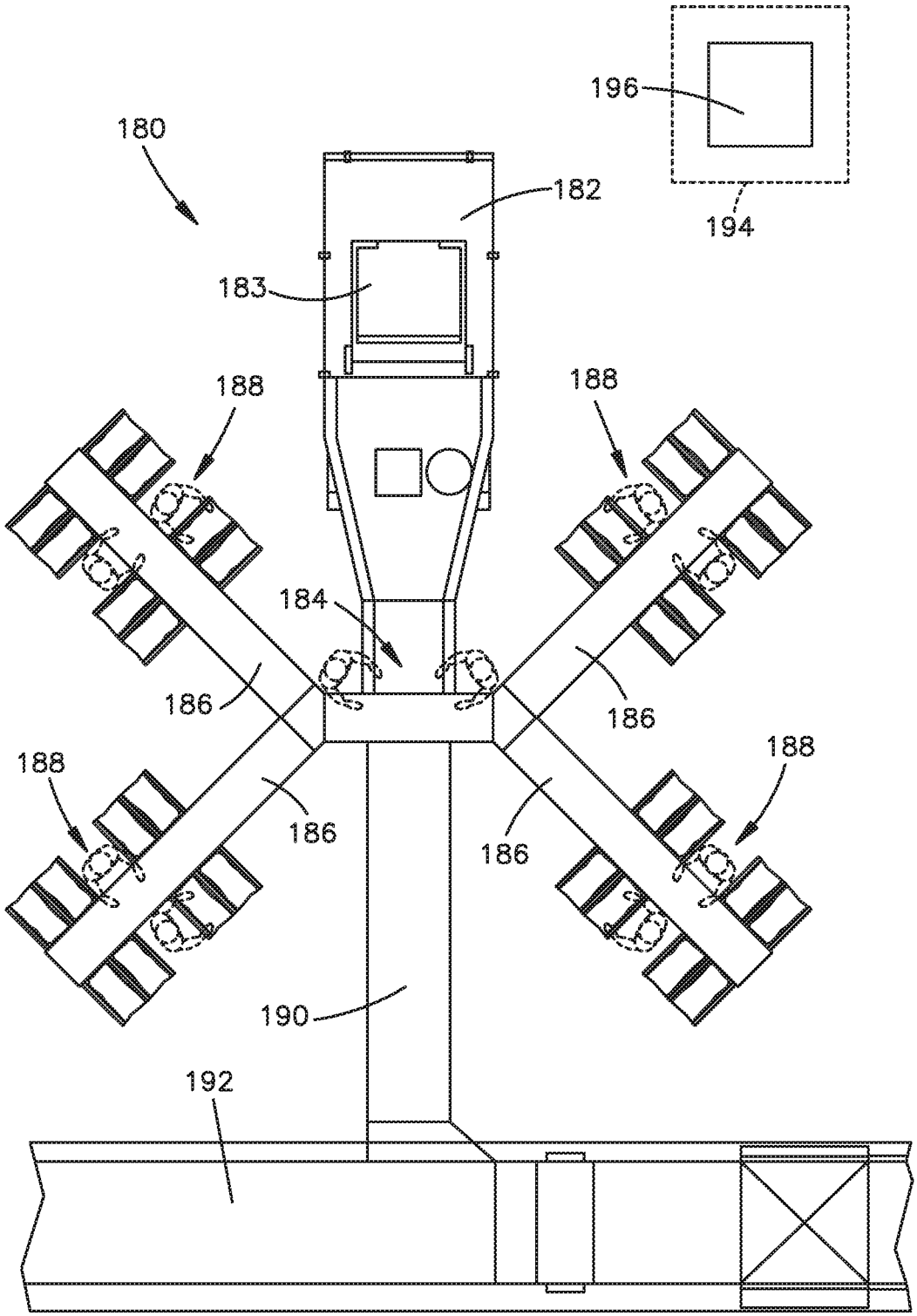
FIG. 5 shows a plan diagram of a sorting area for sorting pluralities of small packages into conveyable sortation bags, similar to the bags shown in FIGS. 1 through 4, and for conveying the bags to a primary sorter induction line, according to an embodiment of the present disclosure.

Referring now to FIG. 5, an example sorting area 180 is shown that employs the bags 2 described above. The sorting area 180 can include a "dumper" 182 that is configured to receive a gaylord 183 filled with small packages and unload the contents of the gaylord 183 to an intermediate stage 184. The dumper 182 can include one or more sensors for identifying packages that are sized larger than small packages. Such non-small objects can be transported, manually or automatically, to a primary sorter induction line. At the intermediate stage 184, one or more operators can sort and induct small packages onto one of a plurality of spur belts 186 based on the staging destination of the package. Each of the spur belts can 186 can convey packages to a sorting station 188, where one or more additional operators can direct the small packages into a bag 2 configured as set forth above. When a bag 2 is full, an operator can close the bag 2 and place it on conveyor 190 leading to a primary sorter induction line 192, from which the filled bag 2 can be conveyed to a staging destination 194. At the staging destination 194, the bags 2 can optionally be stacked onto a pallet 196. As set forth above, the substantially cuboid configuration of the filled bags 2 also allows the bags 2 to be stacked onto a pallet 196 in a manner substantially similar to that of a box for further shipping from the order handling center.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated. Also, the present invention is not intended to be limited by any description of drawbacks or problems with any prior art device.

Unless explicitly stated otherwise, each numerical value and range should be interpreted as being approximate as if the word "about" or "approximately" preceded the value or range.

It should be understood that the steps of exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

What is claimed is:

1. A bag that is configurable into a receiving configuration for receiving a plurality of sorted items, the bag comprising:

a first side panel of material and a second side panel of material located opposite one another when the bag is in the receiving configuration, wherein one or more of the first and second side panels of material at least partially defines an opening through which the sorted items can be inducted into the bag; and a peripheral panel of material extending between the first and second side panels of material and along respective peripheries thereof so as to couple the first and second side panels of material together at the respective peripheries, the peripheral panel of material defining:

a bottom section at a bottom end of the bag located opposite the opening when the bag is in the receiving configuration;

a first corner section extending from the bottom section; and a second corner section extending from the bottom section and located opposite the first corner section, wherein, when the bag is in the receiving configuration, the bottom section is rectangular, and the first and second corner sections are each rectangular and are substantially oriented at a relief angle in a range of about 35 degrees to about 50 degrees away from the bottom section toward an upper end of the bag opposite the bottom section, and wherein the first side, second side, and peripheral panels of material are cooperatively configured such that the bag assumes a substantially cuboid shape responsive to induction of the plurality of sorted items within the bag.

2. The bag of claim 1, wherein the peripheral panel of material defines a first lateral end section and a second lateral end section located opposite each other when the bag is in the receiving configuration, the first and second lateral end sections extending respectively between the first and second corner sections and the opening, wherein the first side, second side, and peripheral panels of material are cooperatively configured such that the first and second lateral end sections each assume a substantially rectangular shape responsive to induction of the plurality of sorted items within the bag.

3. The bag of claim 1, wherein the opening is located at the upper end of the bag when the bag is in the receiving configuration.

4. The bag of claim 1, wherein the opening is spaced intermediate the upper end of the bag and the bottom end of the bag when the bag is in the receiving configuration.

5. The bag of claim 1, wherein the material of one or more of the first side panel of material, the second side panel of material, and the peripheral panel of material comprises one or more of blended mesh polypropylene and nylon.

6. The bag of claim 1, wherein the first and second side panels of material define a first pair of apertures and a second pair of apertures, such that the first pair of apertures are aligned when the bag is in the receiving configuration, and the second pair of apertures are aligned when the bag is in the receiving configuration, and the first pair of apertures are each configured to receive a first support arm therethrough and the second pair of apertures are each configured to receive a second support arm therethrough in a manner retaining the bag in the receiving configuration.

7. The bag of claim 6, wherein the first and second side panels of material each define at least one aperture that is elongated so as to define a handle.

8. The bag of claim 1, wherein the first and second side panels of material each define a length between the opening and the bottom end of the bag, the peripheral panel of material is configured to extend between the first and second side panels of material at a distance, and a ratio between the distance and the length is no more than 0.5:1.

9. The bag of claim 1, wherein the first and second side panels of material each define a length between the opening and the bottom end of the bag and a width that is perpendicular to the length, wherein a ratio between the length and the width is at least 1.2:1.

10. The bag of claim 9, wherein the first side panel of material carries a feature configured to receive one or more of a label and an RFID tag for identifying packages within the bag, wherein the feature comprises one or more of a 1) plate embedded in the first side panel of material and 2) a pouch attached to the first side panel of material.

11. The bag of claim 10, wherein a lateral edge of the feature is substantially aligned with a lateral midpoint of the first side panel of material, and the feature is configured to allow the allow the bag to be folded about the lateral midpoint without interfering with the fold.

12. The bag of claim 1, wherein edges of the peripheral panel of material and the peripheries of the first and second side panels of material are jointly sewn to a binder strip.

13. The bag of claim 12, wherein the binder strip is formed of warp knit polyester.

14. The bag of claim 5, wherein the material is a monofilament weave of blended mesh, polypropylene filaments.

15. The bag of claim 14, wherein the material is semi -transparent and viewable by image sensors external of the bag.

* * * * *